US005974937A

United States Patent [19]

Doughty et al.

[11] Patent Number: 5,974,937

[45] Date of Patent: Nov. 2, 1999

[54] METHOD AND SYSTEM FOR REMOVING AND EXPLOSIVE CHARGE FROM A SHAPED CHARGE MUNITION

[75] Inventors: James L. Doughty, Neosho, Mo.; Denzil D. Smith, Edna, Kans.

[73] Assignee: Day & Zimmermann, Inc., Parsons, Kans.

[21] Appl. No.: 09/054,897

[22] Filed: Apr. 3, 1998

[51] Int. Cl.[6] ..... F42B 33/06; F42B 33/00

[52] U.S. Cl. ..... 86/49; 86/50

[58] Field of Search ..... 86/49, 50; 102/293; 588/202

[56] References Cited

U.S. PATENT DOCUMENTS

| | | | |
|---|---|---|---|
| 1,492,922 | 5/1924 | Knight | 86/49 |
| 1,492,925 | 5/1924 | Knight | 134/5 |
| 1,492,956 | 5/1924 | Bots | 134/5 |
| 1,533,486 | 4/1925 | Welch | 86/49 |
| 1,706,938 | 3/1929 | Roberts | 149/55 |
| 1,958,420 | 5/1934 | Deck et al. | 134/98.1 |
| 3,229,561 | 1/1966 | Jones et al. | 86/49 |
| 3,604,297 | 9/1971 | Gilev et al. | 83/50 |
| 3,724,372 | 4/1973 | Phillips | 86/49 |
| 4,028,989 | 6/1977 | Vassallo | 86/49 |
| 4,441,400 | 4/1984 | Sexton | 86/49 |
| 4,754,684 | 7/1988 | Borgherest | 86/24 |
| 5,105,697 | 4/1992 | Gruber | 83/98 |
| 5,295,428 | 3/1994 | Heitmann et al. | 86/49 |
| 5,737,709 | 4/1998 | Getty et al. | 588/202 |
| 5,783,243 | 7/1998 | Benado | 426/425 |

*Primary Examiner*—Charles T. Jordan
*Assistant Examiner*—Jeffrey Howell

[57] ABSTRACT

A method for removing an explosive charge from a shaped charge munition is disclosed together with a system for carrying out the method. The preferred method for removing a charge from a stackable shaped charge munition, such as a M42 or M46 grenade, involves three punching stages using two hollow punch dies of different diameters and lengths to extract the metal cone-shaped liner and all of the explosive except a layer lining the inner side wall and dome end wall of the casing. The thin layer of explosive can be readily removed in an explosive waste incinerator. The system for carrying out the method includes a delivery conveyor, a rotatable indexing table having multiple gripping devices for holding grenades or other shaped charge munitions, multiple punching stations positioned in sequence around the perimeter of the indexing table, and a take-off conveyor for transporting processed grenades from the indexing table. The preferred embodiment also includes a dispenser for inserting paper liners inside processed grenades before the grenades are transferred form the indexing table to the removal conveyor.

20 Claims, 4 Drawing Sheets

METHOD AND SYSTEM FOR REMOVING AND EXPLOSIVE CHARGE FROM A SHAPED CHARGE MUNITION

FIELD OF THE INVENTION

The invention relates to the general field of disarming munitions, and to the more specific field of extracting an explosive charge from a shaped charge munition.

BACKGROUND OF THE INVENTION

The military has, at times, munitions which are either becoming obsolete or are in excess of the quantity desired to be kept in reserve. Various demilitarization programs have been established to deal with this excess and obsolescence.

A demilitarization ("demil") program has been in operation to disarm and recover the salvageable material of a quantity of M509A1 type 155MM artillery rounds loaded with M42/M46 general purpose type grenades. The present demil method includes the following steps: (1) removal of the nose plug; (2) extraction of the artillery round expulsion charge; (3) removal of the base plate; (4) opening the body of the 155MM round by mechanical (cutting) detachment of the ogive and base plate; and (5) hydraulic ejection (downloading) of the M42 or M46 grenades from the body. [This portion (steps 1 through 5) of the M509A1 demil method is not changed by the present invention.]

Each grenade is then disarmed for salvage. First, the fuze housing and the fuze slider is secured to prevent the fuze slider from moving into an armed position. Then, a ⅜ inch diameter hole is mechanically punched through the grenade casing at a point where the flange of a cone-shaped liner is attached to the interior of the casing, deforming the liner and exposing the explosive charge inside the grenade. (FIG. 2 shows an M42 grenade after a hole has been punched through the casing to expose the explosive charge and deform the liner.) The explosive charge in the grenade is then burned away in a controlled burning apparatus known as an Explosive Waste Incinerator ("EWI").

There are several disadvantages of this prior art method. None of the explosive material is salvaged. The EWI process takes a long time to burn away all of the explosive, and must be carefully controlled to minimize high order detonation explosive burning. Even the slow burning away of the explosive produces toxic fumes in the EWI which must be contained and detoxified. Thus, this prior art method contributes to high operating costs and equipment maintenance costs, and does not salvage any of the explosive material.

In conducting this prior art demil process, the present inventors realized that it would be preferable to develop a better method of removing the explosive charge from the grenade. If most of the explosive could be removed before the EWI, the removed explosive could be salvaged for use in commercial demolition charges and the EWI processing could be done at higher passthrough rates and with less toxic fumes and residue. These and other advantages of the invention will be apparent in the description which follows.

SUMMARY OF THE INVENTION

The invention relates to a method and system for removing an explosive charge from a shaped charge munition by a punching operation using hollow punch dies inserted through the open end of the casing and into the explosive charge to crumble and extract most of explosive charge. In the preferred embodiment, a vacuum collection system is used for extracting the explosive charge through the hollow punch dies; however, other extracting means may be used.

There are several variations of the method and alternate embodiments of the punch dies. The preferred method for removing the charge from a stackable shaped-charge munition, such as a M42 or M46 grenade, involves three punching stages using two hollow punch dies of different diameters and lengths to extract the metal cone-shaped liner and all of the explosive except a layer lining the inner side wall and dome end wall of the casing. Also described, however, are two-stage and single-stage punching methods. For demil processing of shaped charge munitions having different configurations, such as munitions without a liner, or without a stacking dome, the two-step process or the single-step process may be preferred.

In the preferred three-stage punching method, the explosive charge is removed from an M42 grenade by the following steps. A first hollow punch die is provided having a slightly smaller outside diameter than the inside diameter of the main bore of the grenade casing and with an inwardly beveled cutting edge and swaging surface. The first punch die is inserted into the open end of the casing to contact the cone-shaped liner; then, a hydraulic punching step is performed with penetration just deep enough to cut the liner from the casing wall. The liner is pulled out of the casing as the first punch die is extracted. The first punch die, or another die having essentially the same outside diameter as the first die, is then inserted into the casing to contact the explosive, and a low force punching step is conducted to the depth of just above the dome shoulder of the dome end of the casing. This punching step causes the explosive to crumble inside the hollow bore of the die and be suctioned back into a vacuum collection system. In the third punching stage, a second hollow punch die, having a slightly smaller outside diameter than the inside diameter of the reduced bore of the dome of the casing and having an inwardly beveled cutting edge, is inserted to contact the explosive remaining in the dome, and a second low force punching step is conducted to the depth of just above the end wall of the casing. This punching step causes the remaining explosive to crumble inside the hollow bore of the second punch die and be suctioned back into the vacuum collection system. The process results in a casing with only a thin layer of explosive on the inner walls of the casing which can be readily removed by the EWI processing, a clean salvage of most of the metal of the cone-shaped liner, and a clean salvage of most of the explosive charge.

The system used to carry out the method of the present invention is a novel combination of equipment arranged to efficiently remove explosive charges from grenades or other shaped charge munitions at high pass-through rates. The system comprises a delivery conveyor, a rotatable indexing table having multiple gripping devices for holding grenades or other shaped charge munitions, multiple punching stations positioned in sequence around the perimeter of the indexing table, and a take-off conveyor for transporting processed grenades or munitions from the indexing table. The preferred embodiment also includes a dispenser for inserting paper liners inside the processed grenades before the grenades are transferred from the indexing table to the take-off conveyor.

The preferred embodiment is an automated system which includes three punching stations. However, variations of the system may include fewer punching stations.

BRIEF DESCRIPTION OF THE DRAWINGS

For a better understanding of the present invention, reference is made to the accompanying drawings. It should be understood, however, that the invention is not limited to the arrangement and instrumentalities shown in the drawings.

DETAILED DESCRIPTION OF THE INVENTION

The present invention is a method and system for removing an explosive charge from shaped charge munitions, and is described below with regard to removal of an explosive charge from a U.S. Army M42 general purpose grenade. The invention is, however, adaptable to other shaped charge munitions, both with and without liners or a stackable configuration. As used in this description, a shaped charge munition is one where a casing encloses an explosive charge having a generally conical indentation or shape, oriented such that the open base of the cone is directed toward an end of the casing to concentrate the blasted effect in that direction.

Figure 1:
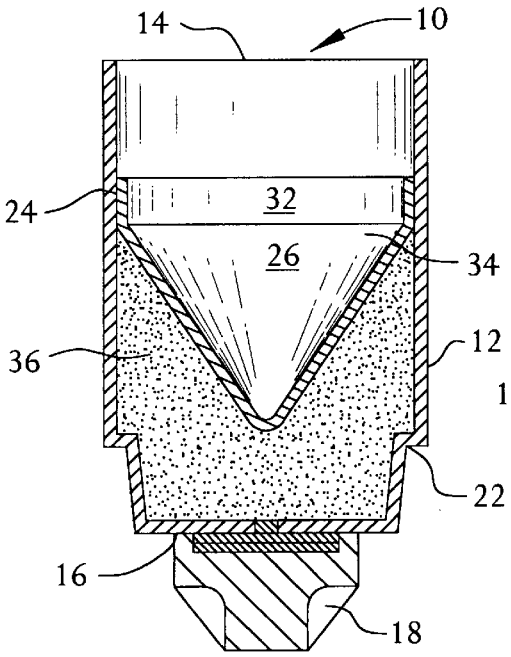
PRIOR ART FIG. 1
FIG. 1 is a partial cross-sectional view of a U.S. Army M42 grenade.
Figure 2:
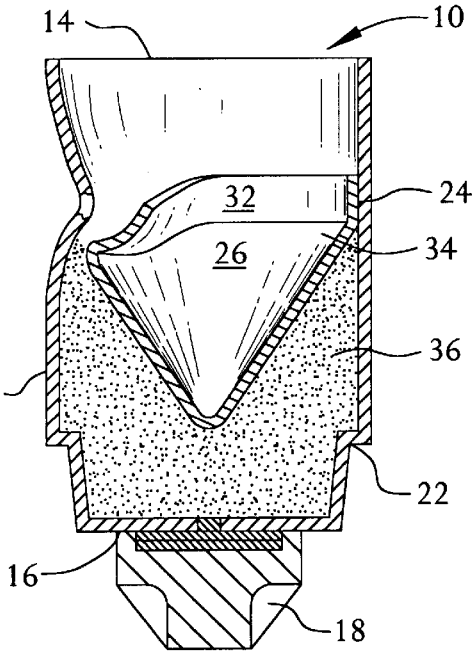
PRIOR ART FIG. 2
FIG. 2 is a cross-sectional view of a U.S. Army M42 grenade after a hole has been mechanically punched through the casing to expose the explosive charge and deform the cone-shaped liner in the manner of the prior art methods.

Shown in FIGS. 1 and 2 are cross-sections of M42 grenades. The M42 is typical of shaped charge general purpose type grenades (identified generally by reference number 10 in the drawings) that are carried to the target in large gun projectiles or air-delivered bombs. The grenade 10 has a hollow metal casing 12 with an open end 14 and an opposite closed end 16, sometimes referred to herein as the dome end. There is a fuze mechanism 18 attached to the closed end of the grenade casing. (Details of the fuze mechanism are not important to understanding of the invention.)

The exterior of the casing 12 is generally cylindrical, but has a smaller diameter near the dome end 16 to permit stacking of the grenades in the delivery projectile. This can be seen in FIG. 2 by noting that the casing has a uniform outside diameter from the open end 14 to a dome shoulder 22, and a smaller outside diameter from the shoulder 22 to the dome end 16. (When rows of grenades are stacked in a delivery projectile, the dome end 16 of one grenade is inserted into the bore of the open end 14 of an identical second grenade until the rim of the open end of the second grenade rests on the dome shoulder 22 of the first grenade.)

The interior of the casing 12 is also generally cylindrical, but the interior side wall has a small reduction in bore diameter to form a rim 24 to hold a metal cone-shaped liner 26, and a greater reduction in bore at the dome shoulder 22. This forms a main bore section 28 and a reduced bore section 30 in the interior of the casing, with the main bore transitioning to the reduced bore at the depth of the dome shoulder. The cone liner 26 is a copper structure that has a flange 32 at the open base of a cone-shaped section 34. The liner 26 is attached to the inner side walls of the casing by press-fitting the flange 32 against the walls above the rim 24. A charge of RDX type explosive is enclosed in the area between the closed end 16 and the cone-shaped liner 26, and is referred to herein as the explosive charge 36.

This configuration of the explosive charge 36 is characteristic of shaped charge munitions. The cone shape of the liner 26 directs much of the hot expanding gases of the explosion toward the axis of the cone and out the open end 14 of the casing 12, giving the blast a directional effect. The liner is typically made of copper, and is compacted along the cone axis and melts almost instantaneously, resulting in it being ejected as a high velocity molten jet out the open end of the casing. This directional blast and molten metal jet provide armor penetration to a much greater depth than an omni-directional explosion. The steel casing fragments in the blast to provide anti-personnel shrapnel.

Using the method of the present invention, most of the cone-shaped liner 26 and most of the explosive charge 36 are removed and salvaged from the casing 12 in either a two-stage or a three-stage punching operation.

Figure 3:
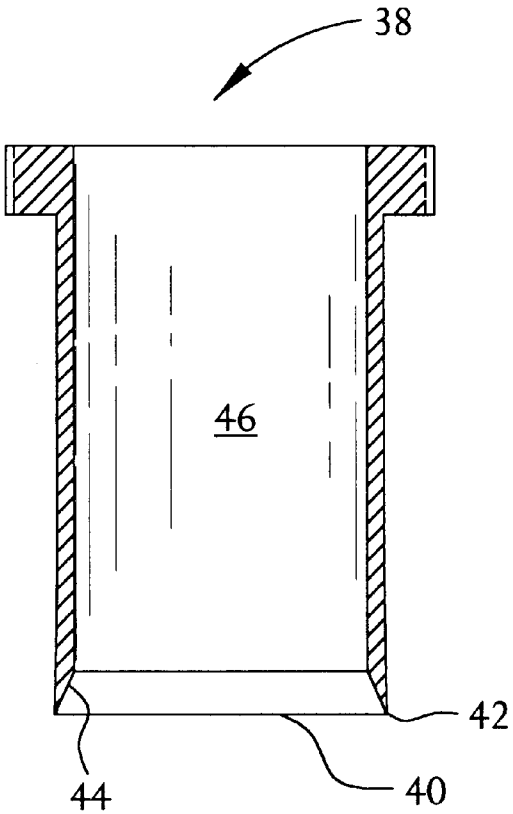
FIG. 3 illustrates a first hollow punch die used in one embodiment of the invention to remove the explosive charge and cone-shaped liner from U.S. Army M42 grenades.

In the two-stage punching operation, the first punching operation uses a hollow punch die 38 designed to remove the liner 26 and a large segment of the explosive charge 36. A first, or "stage one", hollow punch die 38, as depicted in FIG. 3, is used to cut through the circumference of the liner 26 adjacent the rim 24 and swage the severed cone-shaped section 34. The swaged material may pass through the hollow punch die along with crumbled explosive, or may be removed from the die by other means, as described in reference to the system of FIGS. 7 and 8. The first punch die 38 has an outside diameter (1.185 inch for the M42 demil operation) that is slightly smaller than the inside diameter of the main bore of the grenade casing 12 just below the rim 24, and the tip end 40 of the first punch die 38 is inwardly beveled to form a cutting edge 42 and swaging surface 44. The punch has a hollow interior 46 through which the severed cone-shaped section 34 and explosive material may be drawn by suction of a vacuum collection system.

In the first stage of this two-stage punching operation, the first hollow punch die 38 is inserted into the open end 14 of the grenade 10 until cutting edge 42 of the tip end 40 of the punch die comes into contact with the cone-shaped liner 26. Pressure is then applied to cut through the circumference of the liner 26 adjacent the rim 24, swage the severed cone-shaped section 34 so that it will pass through the hollow punch die 38, and crumble the explosive charge 36 in the main bore section 28 of the casing 12. The stop limit of the first punching operation is set to just before reaching the reduced bore section 30.

Figure 5:
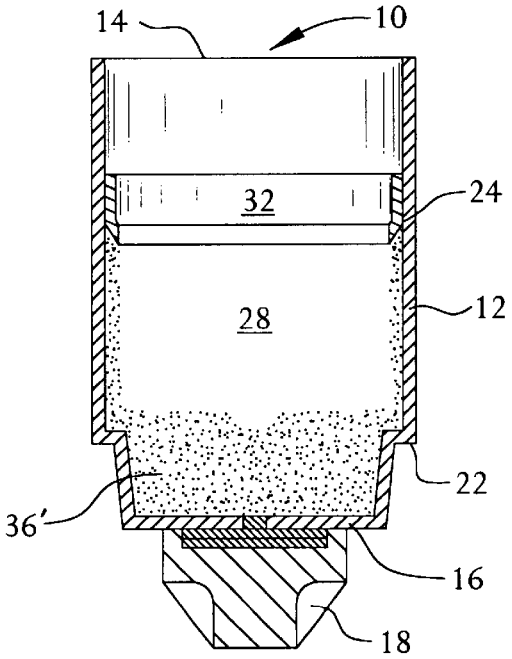
FIG. 5 is a cross-sectional view of a U.S. Army M42 grenade, wherein most of the cone-shaped liner and a substantial part of the explosive have been removed with the first hollow punch die shown in FIG. 3.
Figure 6:
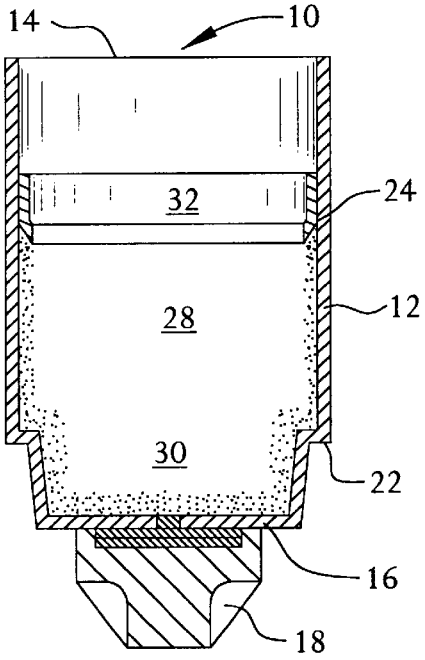
FIG. 6 is a cross-sectional view of the grenade shown in FIG. 5 wherein a substantial portion of the remaining explosive has been removed by the second hollow punch die shown in FIG. 4.
Figure 4:
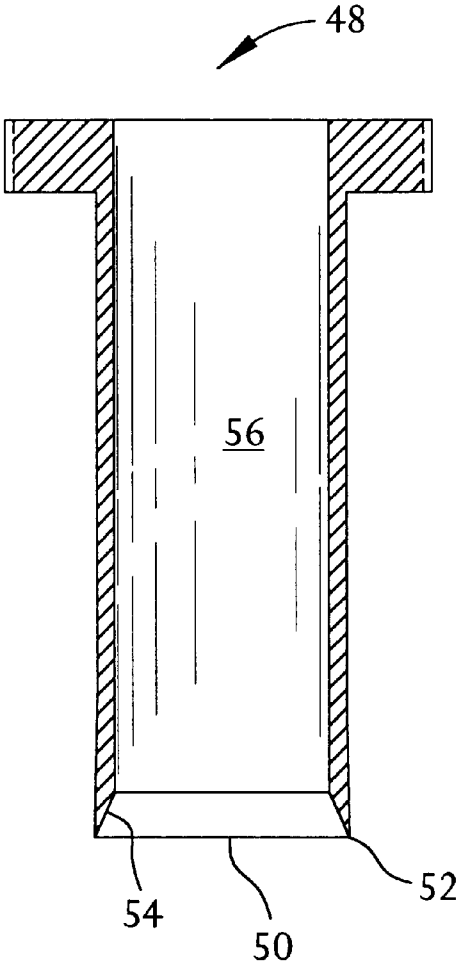
FIG. 4 illustrates a second hollow punch die used in one embodiment of the invention to remove the remaining explosive charge not removed by the first hollow punch die shown in FIG. 3.

The second stage of the two-stage punching operation uses a second, narrower and longer, hollow punch die 48 (FIG. 4) to remove the remaining explosive charge 36', as shown in FIG. 5. In the M42 demil embodiment, the second hollow punch die 48 has an outside diameter (0.965 inch)

that is slightly smaller than the inside diameter of the reduced bore section 30 of the grenade casing 12, and the tip end 50 of the punch is inwardly beveled to form a cutting edge 52 and swaging surface 54. The second punch die has a hollow interior 56 through which crumbled explosive material may be drawn by suction of a vacuum collection system.

The second hollow punch die 48 is inserted into the open end 14 of the grenade 10 until it comes into contact with the remaining explosive charge 36'. Low force pressure is then applied to cut and crumble the remaining explosive charge. The limit of the second punching operation is set to just adjacent the dome end 16 of the reduced bore section 30. The combined use of the first and second punch dies 38, 48 removes most of the cone-shaped liner 26 and more than two-thirds of the explosive charge 36 from a typical M42 general purpose-type grenade.

In the two-stage punching operation described above, however, it was found that the force needed to cut and swage the cone-shaped liner 26 causes explosive charge material to be compressed against and adhere to the extracted cone-shaped liner 34. For that reason, it is presently preferred to use a three-stage punching operation. The first stage of the three-step punching operation is a high-force/short stroke with the first hollow punch die 38 to sever the cone-shaped liner 26 from the casing 12. The liner is held in the first punch die by the slight swaging of the severed edge of the liner and the suction of the vacuum collection system, and the liner is removed from the casing when the first punch die is withdrawn. The first punch die (or an identical punch die) is then reinserted into the casing and an intermediate stage punching operation is done with low force and a longer stroke to remove the explosive charge 36 up to a point adjacent the open end of reduced bore section 30. The third (final) stage punching operation is the same as the final stage of the two-stage operation, using the second hollow punch die 48 to remove the remaining explosive charge 36' from the reduced bore section.

The method using the three-stage punching operation comprises steps including the two-stage punching operation.

In the preferred embodiment, a vacuum collection system is used for extracting the explosive charge 36 enclosed by the hollow punch dies 38, 48. However, other extracting means may be used for this purpose.

Another embodiment of the present invention is a method using a one-stage punching operation. During process verification, 896 grenades were punched only with the second hollow punch die 48 before being processed through the EWI. This removed approximately half of the explosive charge 36 from each grenade. Although this method could be used under certain circumstances, it is highly desirable to remove as much explosive as possible to improve efficiency of the EWI. Increased explosive removal during the punching operations also results in more explosive available for recycling.

Persons skilled in the art will recognize advantages of the present invention over prior art methods of explosive removal. For example, low pressure (approximately 300 to 600 pounds) from the hollow punch dies 38, 48 during removal of the explosive charge 36 makes explosive removal possible without a significant risk of initiating explosion. The invention removes over two-thirds of the explosive charge in M42 and M46 grenades. This allows high rates to be processed through an EWI without a significant risk of high-order detonations. The removed explosive charge remains uncontaminated for salvage.

The tip of the hollow punch dies 38, 48 accomplishes two functions. First, as each die penetrates the explosive charge 36 the angle on the inside diameter of the punch die crumbles the explosive for vacuum extraction. Second, if required by the production process, either of the punch dies 38, 48 can be used to cut and remove both the cone-shaped liner 26 and explosive charge 36 in one pass.

The system of processing equipment used to carry out the abovedescribed method may be varied, as will be recognized by persons skilled in the art. For example, the system 60, shown in FIG. 7, is a novel combination of equipment arranged to efficiently carry out the method of the present invention at high pass-through rates.

Figure 7:
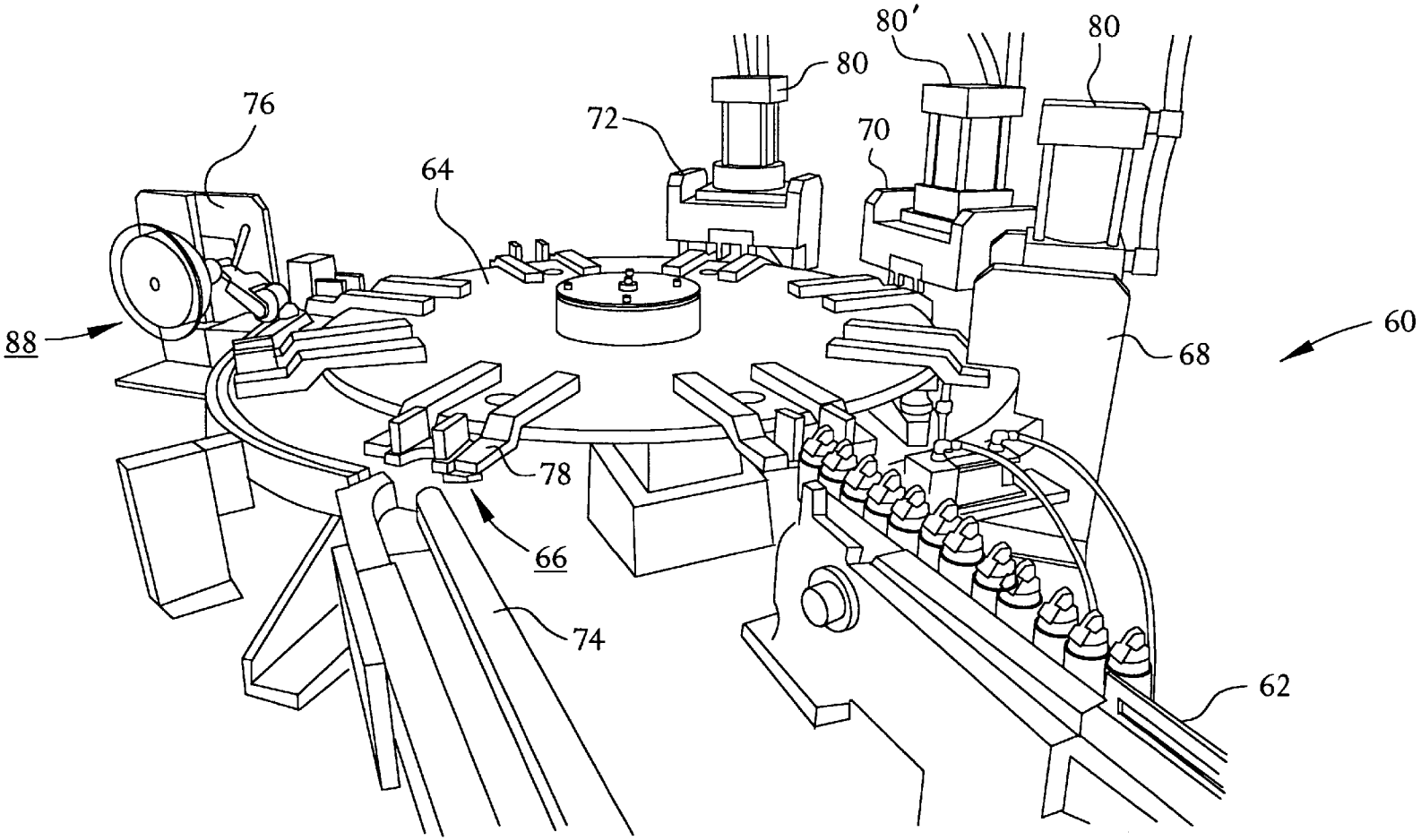
FIG. 7 is a perspective view illustrating the preferred embodiment of the system of the present invention having three punching stations and a paper dispensing station.

As illustrated in FIG. 7, the system 60 comprises a delivery conveyor 62, a movable indexing platform, in this instance a rotatable circular indexing table 64 having multiple gripping devices 66 for holding grenades or other shaped charged munitions, multiple punching stations 68, 70, 72 positioned in sequence around the perimeter of the indexing table, and a take-off conveyor 74 for transporting processed grenades from the indexing table. The preferred embodiment also includes a dispenser 76 for inserting paper liners (or other inserts) inside the processed grenades before the grenades are transferred from the indexing table to the take-off conveyor.

The system 60 is discussed herein with regard to removal of an explosive charge from a U.S. Army M42 general purpose type grenade. The system is adaptable, however, to other shaped charge munitions, both with and without liners or a stackable configuration.

Referring to FIG. 7, the grenades 10 are transported to the rotatable indexing table 64 via the delivery conveyor 62. Each grenade is positioned on the delivery conveyor with the open end 14 of the casing 12 facing down and the dome end 16 facing up, and is transported to the end of the delivery conveyor 62, where the grenade is picked up by one of several gripping devices 66 attached to the rotatable indexing table 64. In the preferred embodiment, each gripping device comprises a nest 78. Multiple gripping devices are equally spaced around the perimeter of the indexing table. The indexing table rotates until a gripping device arrives at the end of the delivery conveyor near the indexing table, where the gripping device picks up a grenade. The indexing table then continues to rotate, transporting the grenade to the first punching station 68.

When the grenade 10 arrives at the first punching station 68, the indexing table 64 stops and the previously described first-stage punching operation is performed. Here, the cone-shaped liner 26 is severed from the casing 12 of the grenade by the first hollow punch die 38. In the preferred embodiment, the first hollow punch die, which is positioned below the grenade and driven upward by a hydraulic cylinder 80, is inserted into the open end 14 of the casing until the cutting edge 42 of the tip end 40 of the first punch die comes into contact with the cone-shaped liner 26 of the grenade. The liner is cut and swaged as previously described. A rod (not shown), which is air driven, then moves up to push the severed cone-shaped section 34 off of the punch die 38 and into a side suction line (not shown). A vacuum collection system pulls the severed cone-shaped section through the suction line to a collection drum (not shown) into which the severed cone-shaped section falls by gravity. Any explosive charge removed with the severed cone-shaped section is pulled by vacuum into the central explosive vacuum collection system.

Figure 8:
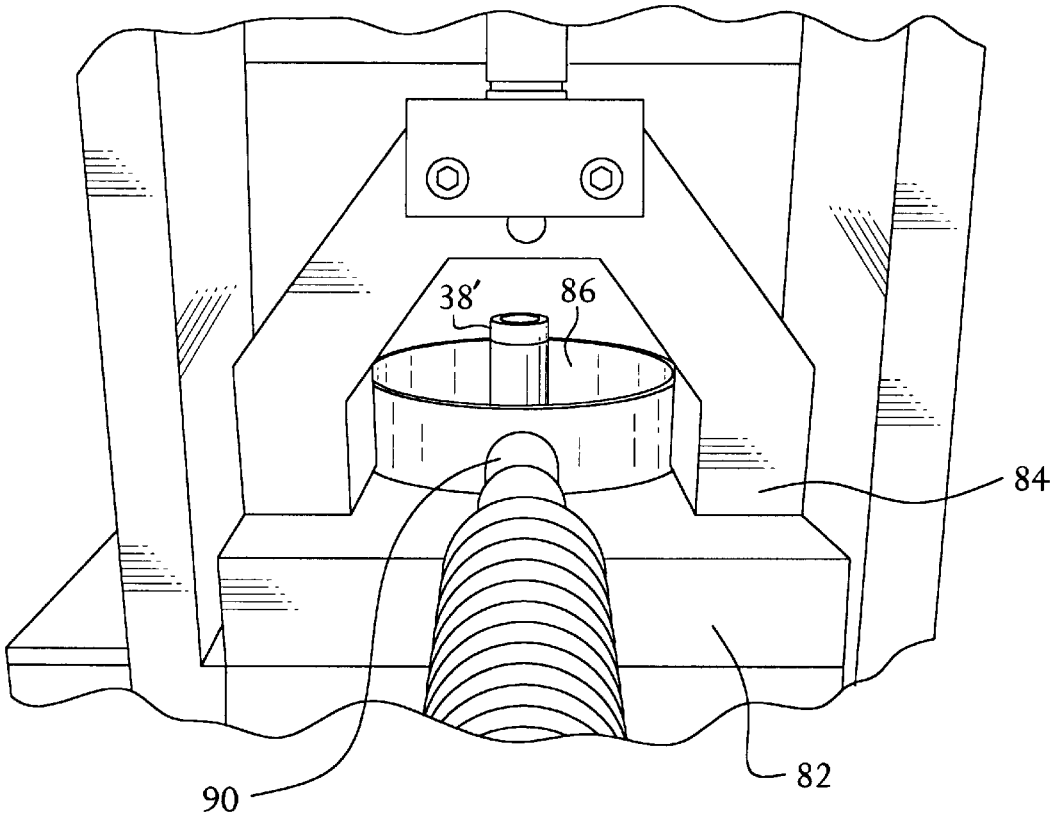
FIG. 8 is a perspective view illustrating a hollow punch die inside a collection ring connected to a vacuum collection system at one of the punching stations of the preferred embodiment shown in FIG. 7.

The indexing table 64 then rotates to transport the grenade 10 in the gripping device 66 to the second punching station 70. Rotation of the indexing table stops when the grenade arrives at the second punching station, where the second-stage punching operation is performed. Positioned below the grenade at the second punching station is another hollow punch die 38', which is identical to the punch die 38 at the first punching station 68. As shown in FIG. 8, this punch die 38' is located on a plate 82 attached to a yoke 84. A hydraulic cylinder 80' on top of the punching station 70 pulls the yoke up and inserts the punch die 38' into the grenade to remove the explosive charge 36. As previously discussed, the tip end 40' of the punch die 38' is inserted to a point adjacent the reduced bore section 30 of the grenade. The explosive charge crumbles and falls into the hollow interior 46' of the punch die 38', which is connected to the central vacuum collection system (not shown). As shown in FIG. 8, a collection ring 86 surrounds the punch die 38' and collects any loose explosive material which may fall out during this operation. The collection ring also is connected by suction line 90 to the central vacuum collection system, which is common to all of the punching stations 68, 70, 72.

While the second stage punching operation is performed on the first grenade 10, a second grenade (which has been transported from the delivery conveyor 62 to the first punching station 68 in the manner previously described for the first grenade) is operated on by the first punching station (as in the manner previously described for the first grenade). After the second punching operation is completed on the first grenade and the first punching operation is completed on the second grenade, the indexing table 64 rotates again, moving the first grenade to the third punching station 72 and the second grenade to the second punching station 70. At the same time, a third grenade is transported to the first punching station (in the manner previously described for the first grenade).

At the third punching station 72, the third stage punching operation is performed on the first grenade 10 in the manner previously described. Specifically, a second hollow punch die 48 is inserted into the open end 14 of the casing 12 until the tip end 50 comes into contact with the remaining explosive charge 36'. Low force pressure is applied to cut and crumble the remaining explosive charge. The second punch die is inserted to a point where the tip end 50 is adjacent the closed end of the reduced bore section 30. Removal of the remaining explosive charge 36' at the third punching station is the same as the removal process at the second punching station 70 (previously discussed).

In the preferred embodiment, after completion of the third-stage punching operation, the processed grenade 10 in the gripping device 66 is transported (via rotation of the indexing table 64) to a fourth station 88. At the fourth station, a paper dispenser 76 dispenses a piece of paper (or cardboard or other such insert) and inserts the paper (or other insert) into the open end 14 of the casing 12 adjacent the flange 32. The perimeter of the paper (or other insert) which abuts the inside wall of the casing is held in place by friction, and prevents any remaining explosive charge from falling out during transport of the processed grenade to the EWI.

Further rotation of the indexing table transports the processed grenade 10 to a point adjacent the end of the take-off conveyor 74. At this point, an air cylinder pushes the grenade out of the nest 78 of the gripping device 66 onto the take-off conveyor and the processed grenade is transported to the EWI. As the system 60 continues to operate, grenades are similarly processed as described above and, after being processed, are transported to the EWI.

The present invention may be embodied in other variant forms where the variation does not substantially differentiate from the essential novelty and uniqueness revealed in the foregoing disclosure. Reference should therefore be made to the appended claims rather than the foregoing specification, as indicating the scope of the invention. It should be understood that many modifications, variations and changes may be made without departing from the spirit and scope of the invention as defined in the claims.

What is claimed is:

1. A method for removing explosive from a munition wherein a casing encloses an explosive charge having a generally conical indentation or shape, defining an open base directed toward one end of the casing to concentrate the force of the blast effect in that direction, the method comprising the steps of:

inserting a hollow punch die through the end of the casing and into the explosive; and extracting the explosive enclosed in the die.

2. The method as in claim 1, wherein the inserting step includes inserting the hollow punch die to a depth at which the die is just adjacent an end of the casing opposite the said one end.

3. The method as in claim 1, wherein the extracting step includes providing a vacuum to draw the explosive through the hollow punch die.

4. The method as in claim 2, wherein the extracting step includes providing a vacuum to draw the explosive through the hollow punch die.

5. A method for removing explosive from a munition wherein a cylindrical casing having a main bore section and a reduced bore section encloses an explosive charge having a generally conical indentation or shape, defining an open base in the main bore section of the casing and directed toward an end of the casing, the method comprising the steps of:

inserting a first hollow punch die, having an outside diameter slightly less than the inside diameter of the main bore section of the casing, through the end of the casing and into the explosive charge; and extracting the explosive enclosed in the first die;

inserting a second hollow punch die, having an outside diameter slightly less than the inside diameter of the reduced bore section of the casing, through the end of the casing and into any remaining explosive charge; and extracting the explosive enclosed in the second die.

6. The method as in claim 5, wherein the first inserting step includes inserting the first hollow punch die to a depth near the transition of the main bore section to the reduced bore section.

7. The method as in claim 6, wherein the extracting steps include providing a vacuum to draw the explosive through the respective hollow punch dies.

8. A method for removing an explosive charge from a munition having a hollow cylindrical casing with a closed end and an open end and an interior wall formed by a cone-shaped liner inside the casing with the base of the cone directed toward the open end, and the explosive charge enclosed in the casing between the closed end and the cone-shaped liner, the method comprising the steps of:

inserting a hollow punch die through the open end of the casing to the liner;

punching the die through the liner to sever substantially all of the liner from the casing;

removing the severed portion of the liner from the casing;

inserting a hollow punch die through the open end of the casing and into the explosive charge; and extracting the explosive enclosed in the die.

9. The method as in claim 8, wherein the same hollow punch die is used to sever the liner and to extract the explosive.

10. The method as in claim 8, wherein the extracting step includes providing a vacuum to draw the explosive through the respective hollow punch dies.

11. The method as in claim 9, wherein the extracting step includes providing a vacuum to draw the explosive through the hollow punch die.

12. A method for removing an explosive charge from a munition having a hollow cylindrical casing with a closed end and an open end and having a main bore section and a reduced bore section, and an interior wall formed by a cone-shaped liner inside the main bore section with the base of the cone directed toward the open end of the casing, and the explosive charge enclosed in the casing between the closed end and the liner, the method comprising the steps of:

inserting a first hollow punch die, having an outer diameter slightly less than the diameter of the main bore section of the casing, through the open end of the casing to the liner;

punching the first die through the liner to sever substantially all of the liner from the casing;

removing the severed portion of the liner from the casing;

inserting the first punch die through the open end of the casing and into the explosive charge; and extracting the explosive enclosed in the first die;

inserting a second hollow punch die, having an outer diameter slightly less than the diameter of the reduced bore section of the casing, through the end of the casing and into any remaining explosive charge; and extracting the explosive enclosed in the second die.

13. A method for removing an explosive charge from a munition having a hollow cylindrical casing with a closed end and an open end and having a main bore section and a reduced bore section, and an interior wall formed by a cone-shaped liner inside the casing with the base of the cone directed toward the open end, and the explosive charge enclosed in the casing between the closed end and the cone-shaped liner, the method comprising the steps of:

inserting a first hollow punch die, having an outer diameter slightly less than the diameter of the main bore section of the casing, through the open end of the casing to the liner;

punching the first die through the liner to sever substantially all of the liner from the casing;

removing the severed portion of the liner from the casing;

inserting a second hollow punch die, having an outer diameter slightly less than the diameter of the main bore section of the casing, through the open end of the casing and into the explosive charge; and extracting the explosive enclosed in the second die; inserting a third hollow punch die, having an outer diameter slightly less than the diameter of the reduced bore section of the casing, through the end of the casing and into any remaining explosive charge; and extracting the explosive enclosed in the third die.

14. The method as in claim 13, wherein the extracting steps include providing a vacuum to draw the explosive through the second and third hollow punch dies.

15. The method as in claim 14, wherein the step of punching the first die through the liner causes swaging of the severed portion of the liner.

16. A processing system for removing an explosive charge from a munition having a hollow cylindrical casing with a closed end and an open end and having a main bore section and a reduced bore section, and an interior wall formed inside the casing by a cone-shaped liner in the main bore with the base of the cone directed toward the open end of the casing, and the explosive charge enclosed in the casing between the closed end and the liner, the system comprising:

a movable indexing platform having gripping devices spaced along a perimeter of the platform for grasping, holding and releasing the munition;

a first punching station adjacent the perimeter of the indexing platform, the punching station having a hollow punch die with an outer diameter slightly less than the diameter of the main bore section of the casing for punching through the liner to sever substantially all of the liner from the casing, and a drive means for inserting the punch die through the open end of the casing and through the liner;

a second punching station adjacent the perimeter of the indexing platform, the punching station having a hollow punch die with an outer diameter slightly less than the diameter of the main bore section of the casing for punching through the explosive in the main bore section, and a drive means for inserting the punch die through the open end of the casing and through the explosive in the main bore section; and a third punching station adjacent the perimeter of the indexing platform, the punching station having a hollow punch die with an outer diameter slightly less than the diameter of the reduced bore section of the casing for punching through the explosive in the reduced bore section, and a drive means for inserting the punch die through the open end of the casing and through the explosive in the reduced bore section.

17. A processing system as in claim 16, further comprising a vacuum collection system supplying a vacuum to the hollow punch dies of the second and third punching station to draw explosive through the dies.

18. A processing system as in claim 17, further comprising a collection ring surrounding each punch die to collect any loose explosive material which may fall out of the casing, and each collection ring being connected by a suction line to the vacuum collection system.

19. A processing system as in claim 18, further comprising the vacuum collection system supplying a vacuum to the hollow punch die of the first punching station to collect the severed cone liners.

20. A processing system as in claim 16, wherein the indexing platform is a circular table, and further comprising:

a delivery conveyer for transporting munitions to the indexing platform and delivering a munition to a gripping device; and a take-off conveyer for transporting munitions away from the indexing platform after a munition has been released by the gripping device.

* * * * *